US012467446B2

(12) United States Patent
Kawabata et al.

(10) Patent No.: US 12,467,446 B2
(45) Date of Patent: Nov. 11, 2025

(54) ACTUATOR AND FLUID CONTROL APPARATUS

(71) Applicant: Murata Manufacturing Co., Ltd., Kyoto (JP)

(72) Inventors: Yutoku Kawabata, Kyoto (JP); Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 145 days.

(21) Appl. No.: 18/063,185

(22) Filed: Dec. 8, 2022

(65) Prior Publication Data

US 2023/0108606 A1 Apr. 6, 2023

Related U.S. Application Data

(63) Continuation of application No. PCT/JP2021/023199, filed on Jun. 18, 2021.

(30) Foreign Application Priority Data

Jun. 23, 2020 (JP) ..... 2020-107697

(51) Int. Cl.
*F04B 43/04* (2006.01)

(52) U.S. Cl.
CPC ..... *F04B 43/046* (2013.01); *F04B 43/04* (2013.01)

(58) Field of Classification Search
CPC .... F04B 43/046; F04B 45/047; F04B 17/003; F04B 2203/0406; F04B 43/0054; F04B 43/043; F04B 43/14; F04B 45/10; F04B 43/02; F04B 45/04
See application file for complete search history.

(56) References Cited

U.S. PATENT DOCUMENTS 10,465,672 B2 * 11/2019 Hirata ..... F04B 43/046
11,536,260 B2 * 12/2022 Mou ..... F04B 43/095
11,698,067 B2 * 7/2023 Kawabata ..... F04B 43/046 417/413.2

(Continued)

FOREIGN PATENT DOCUMENTS

WO 2012/140967 A1 10/2012
WO 2016/181833 A1 11/2016
WO 2019/013164 A1 1/2019

OTHER PUBLICATIONS

International Search Report for PCT/JP2021/023199 dated Jul. 20, 2021.

*Primary Examiner* — Dominick L Plakkoottam
(74) *Attorney, Agent, or Firm* — McDonald Hopkins LLC

(57) ABSTRACT

An actuator includes a frame, a central flat plate and connecting members. The frame has a regular square opening. The central flat plate has a circular shape and is disposed inside the regular square opening. A driving device is attached to the central flat plate. The connecting members are disposed inside the regular square opening at a position between the central flat plate and the frame. The connecting members connect the central flat plate and the frame. Each connecting member includes a first portion and a second portion. The first portion extends in a radial direction extending outward from the center of the central flat plate. The first portion is connected to the central flat plate and to the second portion. The second portion extends in a direction different from the extending direction of the first portion.

14 Claims, 5 Drawing Sheets

(56) References Cited

U.S. PATENT DOCUMENTS

| | | | | |
|---|---|---|---|---|
| 11,930,711 | B2 * | 3/2024 | Hashimoto | H10N 30/2042 |
| 11,952,994 | B2 * | 4/2024 | Fujisaki | F04B 43/046 |
| 2009/0148318 | A1 * | 6/2009 | Kamitani | F04B 45/04 417/413.2 |
| 2013/0058818 | A1 * | 3/2013 | Hirata | F04B 45/047 417/479 |
| 2013/0266461 | A1 * | 10/2013 | Hirata | F04B 43/0054 417/413.2 |
| 2014/0377099 | A1 * | 12/2014 | Hsueh | F04B 49/22 417/413.2 |
| 2017/0058882 | A1 * | 3/2017 | Hirata | F04B 43/046 |
| 2018/0051686 | A1 | 2/2018 | Tanaka et al. | |
| 2019/0155391 | A1 * | 5/2019 | Hashimoto | G06F 3/0412 |
| 2020/0018303 | A1 * | 1/2020 | Hirata | F04B 43/0054 |
| 2021/0095659 | A1 * | 4/2021 | Kawabata | F04B 45/04 |

* cited by examiner

L2>L1

ACTUATOR AND FLUID CONTROL APPARATUS

CROSS REFERENCE TO RELATED APPLICATION

This is a continuation of International Application No. PCT/JP2021/023199 filed on Jun. 18, 2021 which claims priority from Japanese Patent Application No. 2020-107697 filed on Jun. 23, 2020. The contents of these applications are incorporated herein by reference in their entireties.

BACKGROUND OF THE DISCLOSURE

Field of the Disclosure

The present disclosure is related to an actuator having a structure in which a driving device, such as a piezoelectric element, vibrates a flat plate.

Description of the Related Art

Patent Document 1 discloses a pump. The pump of Patent Document 1 includes a diaphragm, a frame, and connection portions. The frame is disposed so as to surround the diaphragm, and the connection portions connect the frame to the outer edge of the diaphragm. The region between the diaphragm and the frame is a void except for regions occupied by the connection portions. The connection portions are shaped like beams. With this structure, the frame supports the diaphragm using the connection portions so as to enable the diaphragm to vibrate. In other words, the actuator is formed of the diaphragm, the frame, and the connection portions.

Each of the connection portions includes a first portion, a second portion, and third portions.

The first portion has a shape extending in a radial direction (in a direction extending outward from the center of the diaphragm). An end of the first portion in the extending direction thereof is connected to the periphery of the diaphragm. The other end of the first portion in the extending direction thereof is connected to the second portion.

The second portion has a shape extending along the periphery of the diaphragm. A substantially central portion of the second portion in the extending direction thereof is connected to the first portion, and opposite end portions of the second portion in the extending direction are connected to the frame using the third portions that extend in the radial direction.

Patent Document 1: International Publication No. 2012/140967

BRIEF SUMMARY OF THE DISCLOSURE

The pump disclosed in, for example, Patent Document 1 is not easy to manufacture due to the voids being small. In the case of the voids being formed reliably without increasing the size of the pump, the width of the second portion may become small. As a result, a stiffness required for the connection portions cannot be obtained easily, which may degrade the reliability of the actuator.

Accordingly, a possible benefit of the present disclosure is to provide an actuator that includes the connection portions of which the stiffness can be increased easily and that can be reduced in size easily.

The present disclosure provides an actuator that includes a frame, a first flat plate, and multiple connecting members.

The frame has an opening that has a polygonal shape. The first flat plate is shaped circularly and disposed inside the opening. A driving device is attached to the first flat plate. The connecting members are disposed inside the opening at positions between the first flat plate and the frame. The connecting members connect the frame and an outer end portion of the first flat plate so as to leave the part of the opening open. Each of the connecting members includes a first portion and a second portion. The first portion extends from the outer end portion of the first flat plate in a direction away from the first flat plate. The first portion has one end portion connected to the outer end portion and the other end portion connected to the second portion. The second portion extends in a direction different from the extending direction of the first portion. The second portion has opposite end portions in an extending direction of the second portion, and the opposite end portions are respectively connected to different inner end portions of the frame, the inner end portions being inside walls of the opening having the polygonal shape.

With this structure, the openings (voids) between the connecting members and the frame can be enlarged without increasing the external size of the frame. Accordingly, when forming the connecting members, the openings (voids) are made larger, which can reduce the likelihood of the width of the second portion becoming small.

According to the actuator of the present disclosure, the stiffness required for the connection portions can be obtained easily, leading to easy size reduction of the actuator.

DETAILED DESCRIPTION OF THE DISCLOSURE

First Embodiment

Figure 1:
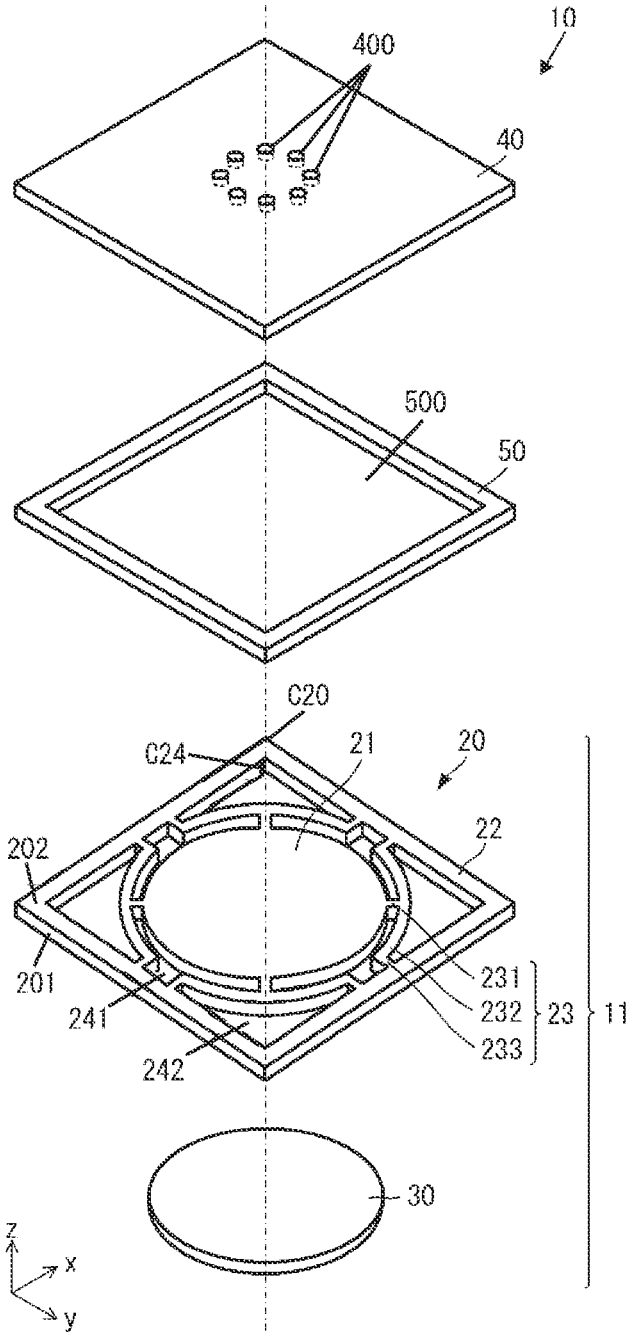
FIG. 1 is an exploded perspective view illustrating a fluid control apparatus 10 with an actuator 11 according to a first embodiment.
Figure 2A:
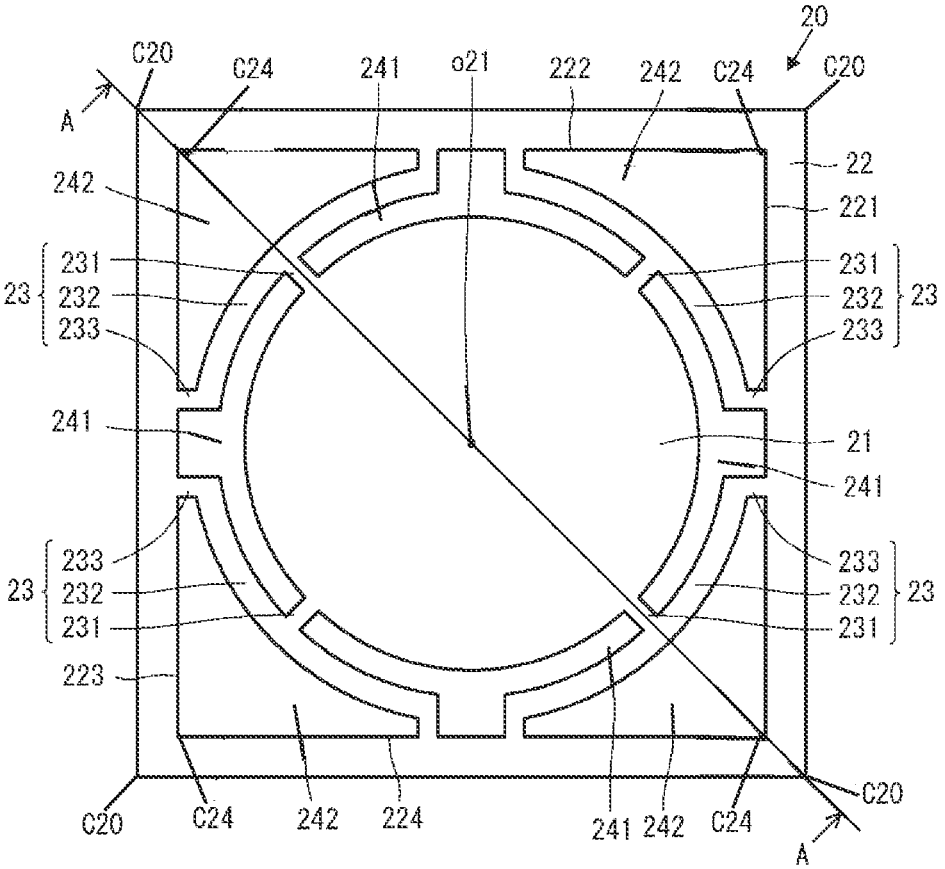
FIG. 2A is a plan view illustrating the actuator 11 of the first embodiment.
Figure 2B:
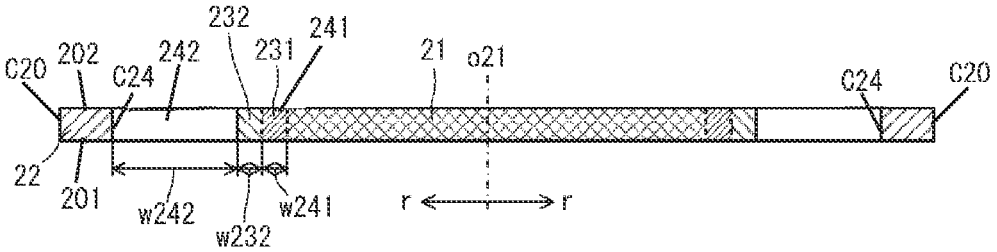
FIG. 2B is a cross-sectional view of the actuator 11 taken along line A-A.
Figure 3:
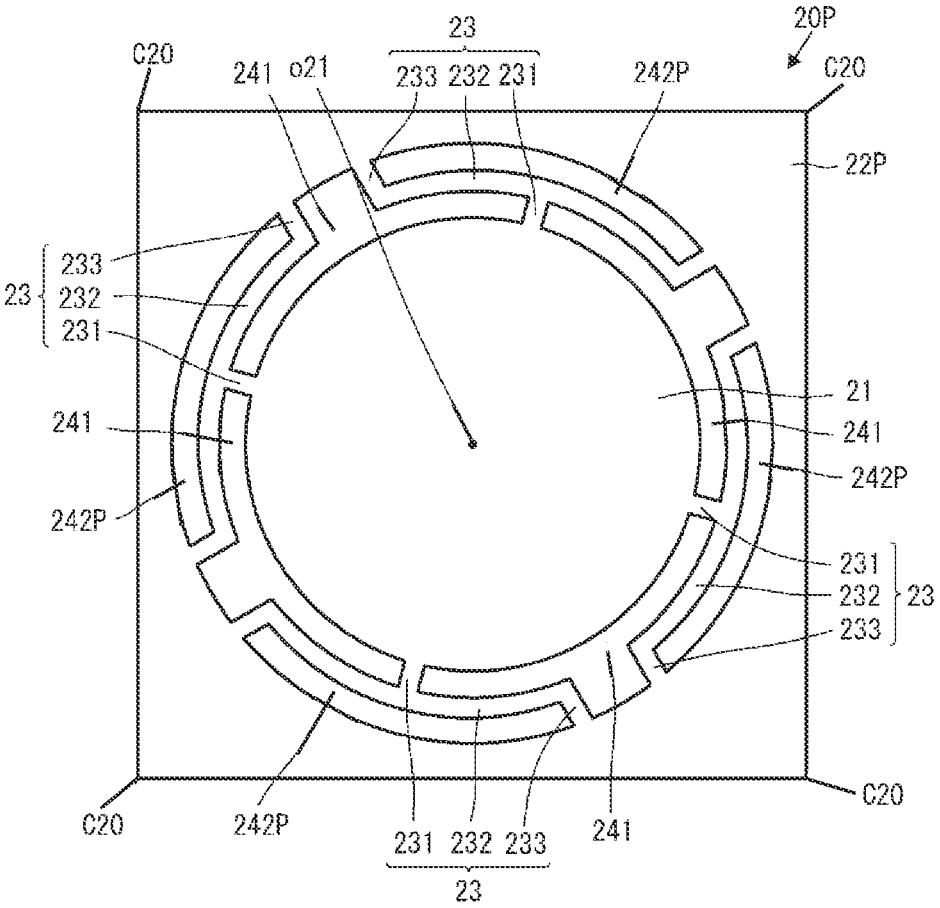
FIG. 3 is a plan view illustrating a known actuator.

An actuator and a fluid control apparatus according to a first embodiment of the present disclosure will be described with reference to the drawings. FIG. 1 is an exploded perspective view illustrating a fluid control apparatus 10 having an actuator 11 according to a first embodiment. FIG. 2A is a plan view illustrating the actuator 11 of the first embodiment, and FIG. 2B is a cross-sectional view of the actuator 11 taken along line A-A. FIG. 3 is a plan view illustrating a known actuator. FIG. 2A and FIG. 3 omit an illustration of a driving device. In these figures, the shapes of the elements of the actuator 11 and the fluid control apparatus 10 are exaggerated partially or entirely in order to facilitate better understanding of the structure.

Structure of Actuator 11

As illustrated in FIG. 1 and FIGS. 2A and 2B, the actuator 11 includes a flat plate member 20 and a driving device 30. The driving device 30 is, for example, a piezoelectric element and is fitted on the flat plate member 20. More specifically, the driving device 30 is fitted on a principal surface 201 of a central flat plate 21 of the flat plate member 20, which is described in detail below.

Structure of Flat Plate Member 20

The flat plate member 20 is made, for example, of a metal and has a principal surface 201 and a principal surface 202. The flat plate member 20 includes the central flat plate 21, a frame 22, and multiple connecting members 23. The central flat plate 21, the frame 22, and the connecting members 23 are formed out of a single flat plate as a single piece.

The central flat plate 21 is a circular flat plate when the central flat plate 21 is viewed in plan (as viewed in the thickness direction thereof or viewed in the z-axis direction). As described above, the driving device 30 is fitted on the principal surface 201 of the central flat plate 21. The central flat plate 21 corresponds to a "first flat plate" of the present disclosure.

The frame 22 is a flat plate shaped like a regular square when the frame 22 is viewed in plan. The frame 22 has an opening. The opening pierces the flat plate that forms the frame 22 in the thickness direction (z-axis direction). The opening is shaped like a regular square as viewed in plan. The shape of the opening and the external shape of the frame 22 are similar and share the same center. In each pair of a corner C20 of the frame 22 and an adjacent corner C24 of the opening, the corner C20 and the corner C24 are positioned in the same direction from the center of the opening. Due to the presence of the opening, the frame 22 has four inner end portions 221, 222, 223, and 224. The inner end portion 221 is parallel to the inner end portion 223, and the inner end portion 222 is parallel to the inner end portion 224. The inner end portion 221 and the inner end portion 223 orthogonally intersect the inner end portion 222 and the inner end portion 224. An end of the inner end portion 221 is connected to an end of the inner end portion 222, and the other end of the inner end portion 222 is connected to an end of the inner end portion 223. The other end of the inner end portion 223 is connected to an end of the inner end portion 224, and the other end of the inner end portion 224 is connected to the other end of the inner end portion 221. Each connection portion of adjacent inner end portions forms the above-described corner C24 of the opening.

The central flat plate 21 is disposed inside the opening of the frame 22. Here, the center of the opening coincide with a center o21 of the central flat plate 21. The area of the central flat plate 21 is smaller than the area of the opening of the frame 22. Accordingly, when the central flat plate 21 is disposed inside the opening of the frame 22, there still remains an opening between the outer end portion of the central flat plate 21 and the frame 22.

The connecting members 23 are shaped like beams. The connecting members 23 are disposed in the opening between the central flat plate 21 and the frame. The connecting members 23 are disposed along the periphery of the central flat plate 21 and are spaced from each other.

With this structure, the central flat plate 21 is supported by the frame 22 with the connecting members 23 interposed therebetween, which enables the central flat plate 21 to vibrate in the bending mode relative to the frame 22.

Specific Structure of Connecting Member 23

Each of the connecting members 23 includes a first portion 231, a second portion 232, and third portions 233. The first portion 231 extends in a radial direction r. As illustrated in FIG. 2B, the radial direction r is a direction extending outward from the center o21 of the central flat plate 21. The second portion 232 is shaped like an arc extending along the periphery of the central flat plate 21. Each third portion 233 extends in the radial direction r.

An end of the first portion 231 in the extending direction thereof is connected to the outer end portion of the central flat plate 21. The other end of the first portion 231 in the extending direction thereof is connected to a substantially central portion of the second portion 232 in the extending direction thereof. Both ends of the second portion 232 in the extending direction thereof are connected to different ones of the inner end portions with respective third portions 233 being interposed therebetween.

More specifically, an end of a second portion 232 is connected to the inner end portion 221, and the other end of this second portion 232 is connected to the inner end portion 222. Similarly, an end of another second portion 232 is connected to the inner end portion 222, and the other end of this second portion 232 is connected to the inner end portion 223. An end of another second portion 232 is connected to the inner end portion 223, and the other end of this second portion 232 is connected to the inner end portion 224. An end of another second portion 232 is connected to the inner end portion 224, and the other end of this second portion 232 is connected to the inner end portion 221.

According to this structure, multiple connecting members 23 connect the central flat plate 21 and the frame 22 so as to form multiple openings 241 and multiple openings 242. The openings 241 are formed so as to include regions between respective second portions 232 and the central flat plate 21, and the openings 242 are formed so as to include regions between respective second portions 232 and the frame 22.

According to this structure, each opening 242 is shaped so as to include the corresponding corner C24. Accordingly, the opening 242 can be formed so as to have a larger opening area, compared with a known art, without enlarging the shape of the frame 22. More specifically, a known flat plate member 20P illustrated in FIG. 3 has arcuate openings between respective second portions 232 and a frame 22P, and the arcuate openings extend along the corresponding second portions 232. On the other hand, in the flat plate member 20 of the present disclosure, as illustrated in FIG. 2B, a distance (opening width) w242 between each second portion 232 and the corresponding corner C24 of the opening is greater than a width w232 of the second portion 232. Accordingly, the area of each opening 242 of the flat plate member 20 of the present disclosure is greater than the area of each opening 242P of the known flat plate member 20. A clearance between each second portion 232 and the frame 22 in the present disclosure is greater than a clearance between each second portion 232 and the frame 22P in the known art except for both end portions of the second portion 232 in the extending direction thereof.

Accordingly, this makes it easier to form the opening 242. In the case where the opening 242 is formed out of a single piece of flat plate or especially in the case where the opening 242 is etched out of a single piece of flat plate, the opening 242 can be formed while the second portion 232 is prevented from becoming smaller in width. In the known structure, when forming the openings 242P reliably without enlarging the shape of the frame 22P as is the case for the structure of the present disclosure, the second portions 232 may become smaller in width. Forming the openings 242 as described in the present disclosure, however, can reduce the likelihood of the width of the second portions 232 becoming smaller.

As a result, the flat plate member 20 can easily maintain the stiffness required for the connecting members 23, which enables the size reduction of the flat plate member 20 more easily. Note that the stiffness required for the connecting members 23 is, for example, a level of stiffness with which the connecting members 23 can be prevented from breaking when the fluid control apparatus 10 having the flat plate member 20 is dropped under certain conditions.

Note that a width w241 of each opening 241 (the clearance between the central flat plate 21 and each second portion 232) is preferably similar to the width w232 of the second portion 232. This can reduce the size of the external shape of the flat plate member 20 as much as possible and the openings 241 can be formed reliably while preventing the size reduction of the central flat plate 21.

The first portion 231 of each connecting member 23 is preferably positioned on an imaginary straight line drawn between the center o21 and the corresponding corner C24. In other words, multiple connecting members 23 are disposed equidistantly along the periphery of the central flat plate 21. This enables the frame 22 to support the central flat plate 21 efficiently. In addition, this enables the third portions 233 at both ends of the second portion 232 to have an equal length. As a result, the support structure can have a favorable axisymmetric property and can support the central flat plate 21 so as to suppress the transmission of the vibrations to the frame 22. For example, the vibratory displacement of the frame 22 can be suppressed to 10% or less of that of the central flat plate 21.

Due to this structure, the length of the second portion 232 from the connection position at which the second portion 232 is connected to the first portion 231 to the connection position at which the second portion 232 is connected to an inner end portion of the frame 22 becomes equal to the length of the second portion 232 from the connection position at which the second portion 232 is connected to the first portion 231 to the connection position at which the second portion 232 is connected to the other inner end portion of the frame 22. As a result, the support structure can have a favorable axisymmetric property and can support the central flat plate 21 so as to suppress the transmission of the vibrations to the frame 22. For example, the vibratory displacement of the frame 22 can be suppressed to 10% or less of that of the central flat plate 21.

With this structure, the extending direction of the first portion 231 orthogonally intersects the extending direction of the second portion 232 at the connection position of the first portion 231 connected to the second portion 232. This can reduce the size of the flat plate member 20 compared with the case where the second portion 232 has the same shape as above and the first portion 231 does not orthogonally intersect the second portion 232.

With this structure, each second portion 232 has a shape elongated along the periphery of the central flat plate 21. Accordingly, if the length of the second portion 232 remains the same, the size of the flat plate member 20 can be reduced, compared with the case of the second portion 232 having other shapes.

Structure of Fluid Control Apparatus 10

The fluid control apparatus 10 that includes the actuator 11 with the above-described structure can be formed as illustrated in FIG. 1. The fluid control apparatus 10 includes the actuator 11, a second flat plate 40, and a side-wall member 50.

The second flat plate 40 is disposed at the side of the principal surface 202 of the central flat plate 21, the frame 22, and the connecting members 23 of the actuator 11. The second flat plate 40 has multiple through holes 400. The through holes 400 are positioned so as to overlap the central flat plate 21 as viewed in plan.

The side-wall member 50 is shaped annularly and has an inside space 500. The side-wall member 50 is disposed between the flat plate member 20 of the actuator 11 and the second flat plate 40. The inside space 500 is shaped substantially similarly to the opening defined by the inner end portions of the frame 22. The side-wall member 50 is connected to the frame 22 and also to the second flat plate 40. A space surrounded by the actuator 11, the side-wall member 50, and the second flat plate 40 (in other words, the inside space 500 of the side-wall member 50) serves as a pump chamber. The pump chamber is in communication with an exterior space outside the fluid control apparatus 10 via the through holes 400 of the second flat plate 40. The pump chamber is also in communication with another exterior space outside the fluid control apparatus 10 via multiple openings 241 and 242 of the actuator 11.

Second Embodiment

Figure 4:
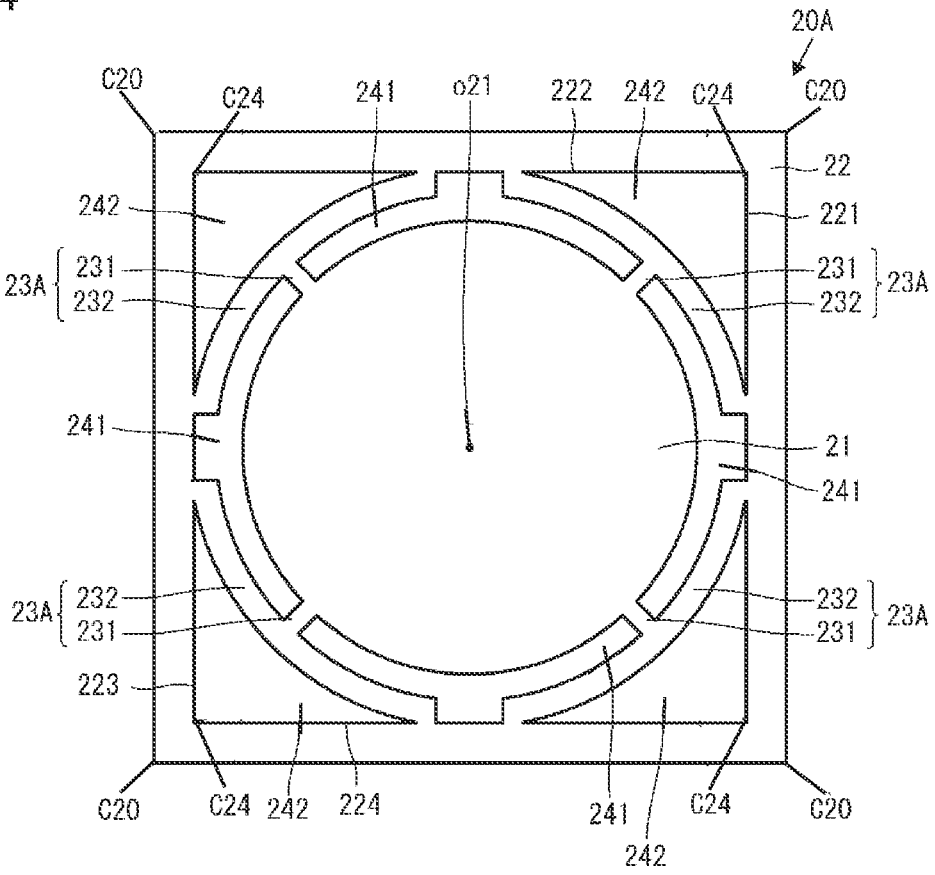
FIG. 4 is a plan view illustrating an actuator according to a second embodiment.

An actuator and a fluid control apparatus according to a second embodiment of the present disclosure will be described with reference to the drawings. FIG. 4 is a plan view illustrating the actuator of the second embodiment.

As illustrated in FIG. 4, the actuator of the fluid control apparatus of the second embodiment has a flat plate member 20A that has a different structure compared with the actuator 11 of the fluid control apparatus 10 of the first embodiment. Other elements of the actuator and the fluid control apparatus of the second embodiment are similar to those of the actuator 11 and the fluid control apparatus 10 of the first embodiment. Descriptions of the similar elements will be omitted.

The flat plate member 20A includes multiple connecting members 23A. Each of the connecting members 23A includes the first portion 231 and the second portion 232. In other words, the connecting member 23A does not include the third portions 233. Both ends of the second portion 232 in the extending direction thereof are directly connected to different inner end portions of the frame 22.

The actuator of the second embodiment having this structure can provide advantageous effects similar to those for the actuator 11 of the first embodiment, while the actuator of the second embodiment can be reduced in size compared with the actuator 11 of the first embodiment.

Third Embodiment

Figure 5:
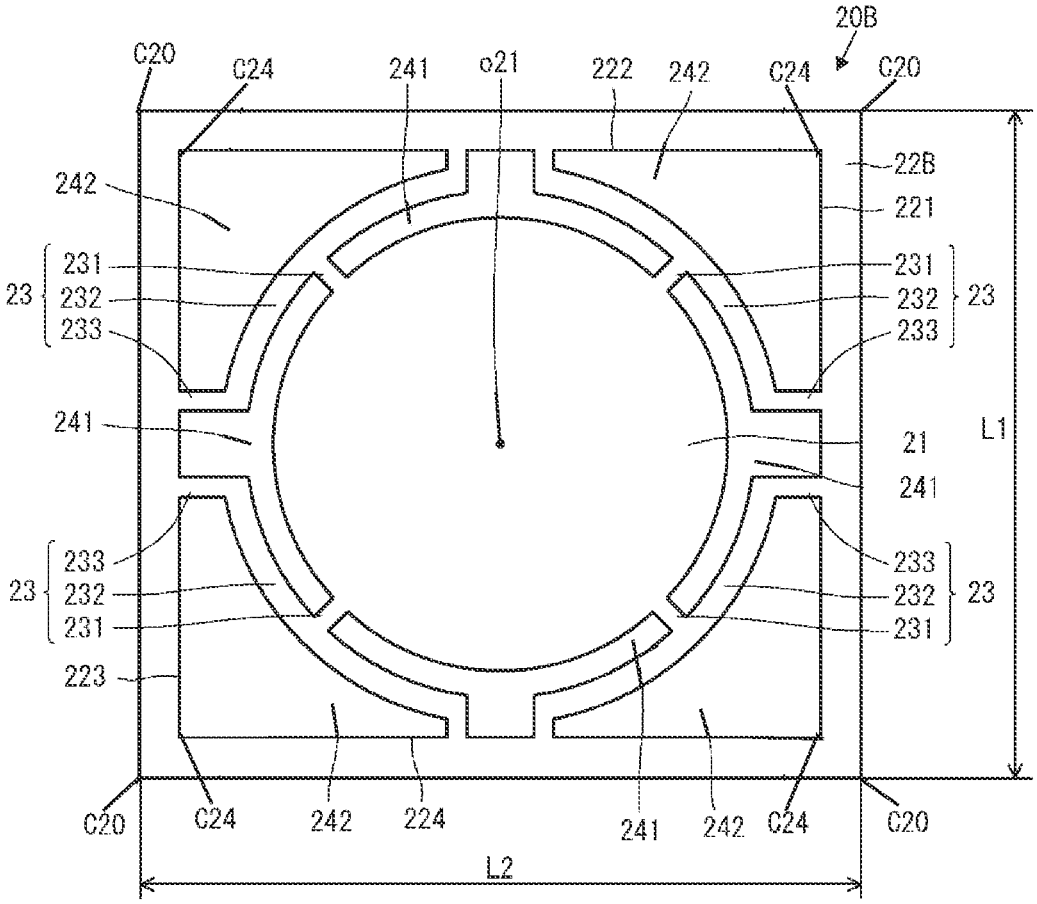
FIG. 5 is a plan view illustrating an actuator according to a third embodiment.

An actuator and a fluid control apparatus according to a third embodiment of the present disclosure will be described with reference to the drawings. FIG. 5 is a plan view illustrating the actuator of the third embodiment.

As illustrated in FIG. 5, the actuator of the fluid control apparatus of the third embodiment has a flat plate member 20B that has a different structure compared with the actuator 11 of the fluid control apparatus 10 of the first embodiment. Other elements of the actuator and the fluid control apparatus of the third embodiment are similar to those of the actuator 11 and the fluid control apparatus 10 of the first embodiment. Descriptions of the similar elements will be omitted.

A frame 22B of the flat plate member 20B is shaped rectangularly, and the frame 22B forms a rectangular opening (opening surrounded by the inner end portions 221, 222, 223, and 224). More specifically, a length L2 of the frame 22B in the direction parallel to the inner end portions 222 and 224 is greater than a length L1 of the frame 22B in the direction parallel to the inner end portions 221 and 223.

The actuator of the third embodiment having this structure can provide advantageous effects similar to those for the actuator 11 of the first embodiment.

Fourth Embodiment

Figure 6:
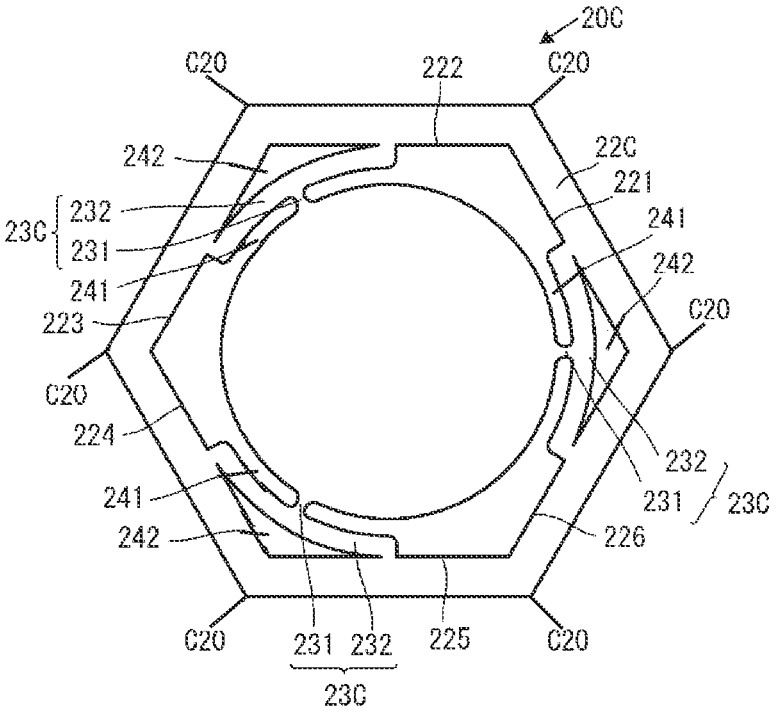
FIG. 6 is a plan view illustrating an actuator according to a fourth embodiment.

An actuator and a fluid control apparatus according to a fourth embodiment of the present disclosure will be described with reference to the drawings. FIG. 6 is a plan view illustrating the actuator of the fourth embodiment.

As illustrated in FIG. 6, the actuator of the fluid control apparatus of the fourth embodiment has a flat plate member 20C that has a different structure compared with the actuator of the fluid control apparatus of the second embodiment. Other elements of the actuator and the fluid control apparatus of the fourth embodiment are similar to those of the actuator and the fluid control apparatus of the second embodiment. Descriptions of the similar elements will be omitted.

A frame 22C of a flat plate member 20C is shaped like a regular hexagon, and the frame 22C defines a hexagonal opening (opening surrounded by inner end portions 221, 222, 223, 224, 225, and 226).

Three connecting members 23C are connected to different inner end portions of the frame 22C. The second portion 232 of a connecting member 23C is connected to an inner end portion 221 and to an inner end portion 226. The second portion 232 of another connecting member 23C is connected to an inner end portion 222 and to an inner end portion 223. The second portion 232 of another connecting member 23C is connected to an inner end portion 224 and to an inner end portion 225.

The actuator of the fourth embodiment having this structure can provide advantageous effects similar to those for the actuator of the second embodiment. In other words, the shape of the frame is not limited to the regular square but may be a different regular polygon. Moreover, the shape of the frame is not limited to a regular polygon but may be just a polygon. This feature can be applied to a flat plate member having rounded corners C20.

In the above embodiments, the connection portions between the central flat plate 21 and the first portion of the connecting member, between the first portion and the second portion, between the second portion and the third portions, and between the third portions and the frame have angled corners. The connection portions, however, may have rounded corners.

In the above description, the side-wall member 50 is connected to the frame at the principal surface 202. A different fixation member, however, may be connected to the frame at the principal surface 201, or different fixation members may be connected to the frame respectively at the principal surface 201 and at the principal surface 202, respectively.

The configurations of the above embodiments may be combined appropriately, and the combination may provide advantageous effects accordingly.

10 fluid control apparatus
11 actuator
20 flat plate member
20A flat plate member
20B flat plate member
20C flat plate member
21 central flat plate
22, 22B, 22C, 22P frame
23, 23A, 23C connecting member
30 driving device
40 second flat plate
50 side-wall member
201, 202 principal surface
221, 222, 223, 224, 225, 226 inner end portion
231 first portion
232 second portion
233 third portion
241, 242, 242P opening
400 through hole
500 inside space

The invention claimed is:

1. An actuator comprising:
a frame having a polygonal opening;
a circularly shaped first flat plate disposed inside the opening and having a driving device attached; and
multiple connecting members disposed inside the opening at positions between the first flat plate and the frame and connecting the frame and an outer end portion of the first flat plate so as to leave a part of the opening open, wherein:
each of the connecting members includes a first portion and a second portion,
the first portion extends from the outer end portion of the first flat plate in a direction away from the first flat plate,
the first portion has one end portion connected to the outer end portion and another end portion connected to the second portion,
the second portion extends in a direction different from the extending direction of the first portion,
the second portion has opposite end portions in an extending direction of the second portion,
the opposite end portions of the second portion are spaced apart and respectively connected to adjacent sides of the opening, and
a width in the polygonal opening measured from at least one of the second portions to a corner formed in the frame closest to the at least one second portion is greater than a width of the second portion.

2. The actuator according to claim 1, wherein a shape of the opening is a regular square.

3. The actuator according to claim 1, wherein the second portion extends in a direction orthogonally intersecting the extending direction of the first portion at a position where the second portion is connected to the first portion.

4. The actuator according to claim 1, wherein the second portion extends along the outer end portion.

5. A fluid control apparatus, comprising:
the actuator according to claim 1;
a second flat plate opposite to the first flat plate, the connecting members and the frame, and having a through hole at a position superposing the first flat plate; and
a side-wall member is connected to the second flat plate and to the frame, and the side-wall member forms a pump chamber in conjunction with the first flat plate, the connecting members, the frame, and the second flat plate.

6. The actuator according to claim 2, wherein the second portion extends in a direction orthogonally intersecting the extending direction of the first portion at a position where the second portion is connected to the first portion.

7. The actuator according to claim 2, wherein the second portion extends along the outer end portion.

8. The actuator according to claim 3, wherein the second portion extends along the outer end portion.

9. The actuator according to claim 2, wherein the opposite end portions of the second portion in the extending direction thereof are connected to the frame.

10. The actuator according to claim 3, wherein the opposite end portions of the second portion in the extending direction thereof are connected to the frame.

11. The actuator according to claim 4, wherein the opposite end portions of the second portion in the extending direction thereof are connected to the frame.

12. A fluid control apparatus, comprising:

the actuator according to claim 2;

a second flat plate opposite to the first flat plate, the connecting members and the frame, and having a through hole at a position superposing the first flat plate; and a side-wall member is connected to the second flat plate and to the frame, and the side-wall member forms a pump chamber in conjunction with the first flat plate, the connecting members, the frame, and the second flat plate.

13. A fluid control apparatus, comprising:

the actuator according to claim 3;

a second flat plate opposite to the first flat plate, the connecting members and the frame, and having a through hole at a position superposing the first flat plate; and a side-wall member is connected to the second flat plate and to the frame, and the side-wall member forms a pump chamber in conjunction with the first flat plate, the connecting members, the frame, and the second flat plate.

14. A fluid control apparatus, comprising:

the actuator according to claim 4;

a second flat plate opposite to the first flat plate, the connecting members and the frame, and having a through hole at a position superposing the first flat plate; and a side-wall member is connected to the second flat plate and to the frame, and the side-wall member forms a pump chamber in conjunction with the first flat plate, the connecting members, the frame, and the second flat plate.

* * * * *